US006536784B2

(12) United States Patent
Gorza et al.

(10) Patent No.: US 6,536,784 B2
(45) **Date of Patent: *Mar. 25, 2003**

(54) BRAKING DEVICE PARTICULARLY FOR ROLLER SKATES

(75) Inventors: Roberto Gorza, Feltre (IT); Walter Trevisan, Venegazzu' (IT); Natalino Bonato, Montebelluna (IT)

(73) Assignee: Benetton Group S.p.A., Ponzano Veneto (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/351,004

(22) Filed: Jul. 12, 1999

(65) Prior Publication Data

US 2002/0067010 A1 Jun. 6, 2002

(30) Foreign Application Priority Data

Sep. 30, 1998 (IT) ..... TV98A0133
Jul. 21, 1998 (IT) ..... TV98A0105

(51) Int. Cl.[7] ..... A63C 17/14

(52) U.S. Cl. ..... 280/11.214; 280/11.215; 280/11.216; 280/11.211; 188/5

(58) Field of Search ..... 280/11.204, 11.205, 280/11.206, 11.207, 11.208, 11.209, 11.211, 11.212, 11.213, 11.214, 11.215, 11.216, 11.217; 188/5

(56) References Cited

U.S. PATENT DOCUMENTS

| | | | | | |
|---|---|---|---|---|---|
| 5,415,419 | A | | 5/1995 | Bourque | |
| 5,435,579 | A | * | 7/1995 | Pozzobon | 280/11.214 |
| 5,486,012 | A | * | 1/1996 | Olivieri | 280/11.214 |
| 5,505,469 | A | * | 4/1996 | Zorzi et al. | 280/11.214 |
| 5,511,804 | A | * | 4/1996 | Pellegrini, Jr. et al. | 280/11.214 |
| 5,590,889 | A | * | 1/1997 | Pozzobon | 280/11.214 |
| 5,653,454 | A | * | 8/1997 | Chin | 280/11.214 |
| 5,735,537 | A | * | 4/1998 | Zorzi | 280/11.214 |
| 5,758,885 | A | | 6/1998 | Lowe | |
| 5,992,862 | A | * | 11/1999 | Mitchell | 280/11.221 |
| 6,007,076 | A | * | 12/1999 | Zorzi et al. | 280/11.216 |
| 6,059,297 | A | * | 5/2000 | Demarchi | 280/11.216 |

FOREIGN PATENT DOCUMENTS

| | | |
|---|---|---|
| EP | 0600274 | 6/1994 |
| EP | 0798022 | 10/1997 |
| WO | 9624414 | 8/1996 |

* cited by examiner

*Primary Examiner*—Brian L. Johnson
*Assistant Examiner*—Hau Phan
(74) *Attorney, Agent, or Firm*—Guido Modiano; Albert Josif; Daniel O'Byrne

(57) ABSTRACT

A braking device for skates having a shoe composed of a quarter which is articulated to a shell which is associated with a supporting frame for two or more wheels. The device has a traction element which operatively connects the quarter to lever system which actuates the movement of a braking element which is slidingly and freely rotatably associated with the frame in a region located in the interspace between two adjacent wheels. The motion occurs in contrast with a spring.

28 Claims, 9 Drawing Sheets

BRAKING DEVICE PARTICULARLY FOR ROLLER SKATES

BACKGROUND OF THE INVENTION

The present invention relates to a braking device particularly usable for skates which comprise a shoe composed of a quarter which is articulated to a shell which is in turn associated with a supporting frame for two or more wheels.

Currently, in known types of roller skate, whether constituted by a shoe associated with a support for two pairs of mutually parallel wheels or by a shoe associated with a supporting frame for one or more in-line wheels, there is the problem of braking said wheels in order to be able to adjust the speed of said skate.

It is known to use blocks or pads, usually made of rubber, which are arranged at the tip or heel region of the shoe. When the user tilts the shoe forward or backward, the free end of the blocks or pads interacts with the ground and braking is thus achieved.

However, such brakes are not optimum, since they require the user to rotate the shoe, and therefore the frame associated therewith, at the tip or heel, and this can cause loss of balance with consequent falls.

U.S. Pat. No. 1,402,010 discloses a roller skate provided with a band which can be fastened to the user's leg above the malleolar region and to which a rod is connected.

The rod wraps around the leg to the rear and is then curved so as to laterally affect the leg until it is associated at its ends, in the malleolar region, with a lever system which is articulated to a structure which protrudes from the wheel supporting frame.

The lever system protrudes laterally and to the rear of the frame and is radiused and connected to a plate which is shaped approximately complimentarily to the curvature of a portion of an underlying and facing wheel.

The above brake is not free from drawbacks: first of all, mutual motion occurs between the band and the leg throughout sports practice and this makes it uncomfortable to use it, due to the continuous rubbing of the band on the leg.

Furthermore, the plate is activated whenever the user bends his leg backward, beyond a certain angle, and there is no actual easy way to vary this condition.

Furthermore, every user has an individual leg shape and therefore braking is achieved for different rotation angles with an equal rod length.

Furthermore, the rod acts at the malleolar region and this can cause discomfort or accidental impacts.

U.S. Pat. No. 4,275,895 partially solves the above drawback by virtue of a brake for skates having two pairs of mutually parallel wheels which acts at the rear wheels. The brake is constituted by a tongue which is associated with the shoe in a rear region and to the rear of which a blade is associated. The blade is pivoted at the shoe supporting frame.

The blade has, at its free end, a transverse element on which there are, at the lateral ends, two C-shaped elements which interact, as a consequence of a backward rotation applied to the tongue, with the rolling surface of the rear wheels that face them.

However, also the above brake has drawbacks: it is in fact structurally complicated and therefore difficult to industrialize. Moreover, it entails the presence of suitable springs which allow to reposition the tongue in the condition in which the two C-shaped elements do not interact with the wheels, and this further increases structural complexity.

Furthermore, the structural configuration of the brake causes the two C-shaped elements to interact with the wheel even if a minimal backward rotation is applied to the tongue and therefore even for unintentional movements: this leads to unintended braking and therefore to possible losses of balance or lack of coordination.

U.S. Pat. No. 4,300,781 relates to a braking device for skates which comprise pairs of mutually parallel wheels. The brake is constituted by a blade which is pivoted transversely at the rear end of the supporting frame for a shoe. Pads are associated with the ends of the blade and face the rolling surface of the pair of rear wheels.

Brake activation occurs by using a cable which is suitable to turn the blade, in contrast with a spring associated with the support for the pair of front wheels, so as to bring the pads into contact with the rolling structure of the pair of rear wheels.

Activation of the cable is allowed by rings or handles which are associated with a band which can be arranged on the lower limbs of the user by virtue of the presence of temporary connection means.

However, this brake entails considerable drawbacks: first of all, the activation of the brake can lead to possible losses of balance during sports practice, because the user's body does not assume a position which is suitable to control the sudden speed reduction; only the hand of the skater is in fact involved in the activation of the brake.

Furthermore, since sports practice can occur while wearing pants, the band may slip along the pants or pull them along the leg when the rings are pulled, thwarting the braking action.

Furthermore, there is a loose cable which in addition to being a hindrance to the skater can accidentally catch during skating, especially since coordination of the movement of arms and legs places them rhythmically laterally outward.

IT-1,257,742, in the name of this same Applicant, partially solves this drawback. IT-1,257,742 discloses a braking device for skates which comprise a shoe composed of a quarter which is articulated to a shell and is associated with a supporting frame for one or more wheels, which comprises at least one traction element which connects the quarter to a braking element which oscillates between the wings of the supporting frame in a region which is interposed between two mutually adjacent wheels.

However, even this skate has drawbacks, since actuation of the braking device when the quarter is tilted is not always optimum and prompt.

SUMMARY OF THE INVENTION

The aim of the present invention is therefore to eliminate the above-cited drawbacks of the prior art by providing a braking device for skates which is efficient from the functional point of view and structurally very simple and compact.

An important object is to fully eliminate the space occupation due to the braking device in the rear region of the skate in order to allow greater freedom of movement to the skater while maintaining a high level of constructive simplicity and the optimum efficiency of the braking device.

Another important object is to provide a braking device which can be at least partially concealed from the user's view so as to increase the aesthetic properties of the skate.

Another important object is to provide a braking device which can be activated quickly, simply and safely by the user without said user having to perform movements, for example with his/her hands, which might compromise his/her balance or coordination and which can be activated by the user when actually necessary and therefore not accidentally.

Another object is to provide a device which associates with the preceding characteristics that of being reliable and safe in use and easy to industrialize, of having low manufacturing costs, and of being also applicable to known types of skate.

This aim, these objects and others which will become apparent hereinafter are achieved by a braking device, particularly for skates comprising a shoe composed of a quarter which is articulated to a shell which is associated with a supporting frame for two or more wheels, comprising at least one traction element which operatively connects said quarter to a braking element, characterized in that said at least one traction element is associated, at one end, with an actuation element which is connected to said quarter or interacts therewith and is guided on a means which is fixed to said shell, can slide thereon and/or on the surface of an innerboot and is connected, at its other end, to a lever system which is suitable to actuate the movement of a braking element which is associated with said frame in contrast with at least one flexible element.

Advantageously, the braking element is rotatably and/or slidingly associated with the frame in the interspace between two adjacent wheels.

BRIEF DESCRIPTION OF THE DRAWINGS

Further characteristics and advantages of the invention will become apparent from the detailed description of particular embodiments, illustrated only by way of non-limitative example in the accompanying drawings, wherein.

DESCRIPTION OF THE PREFERRED EMBODIMENTS

Figure 1:
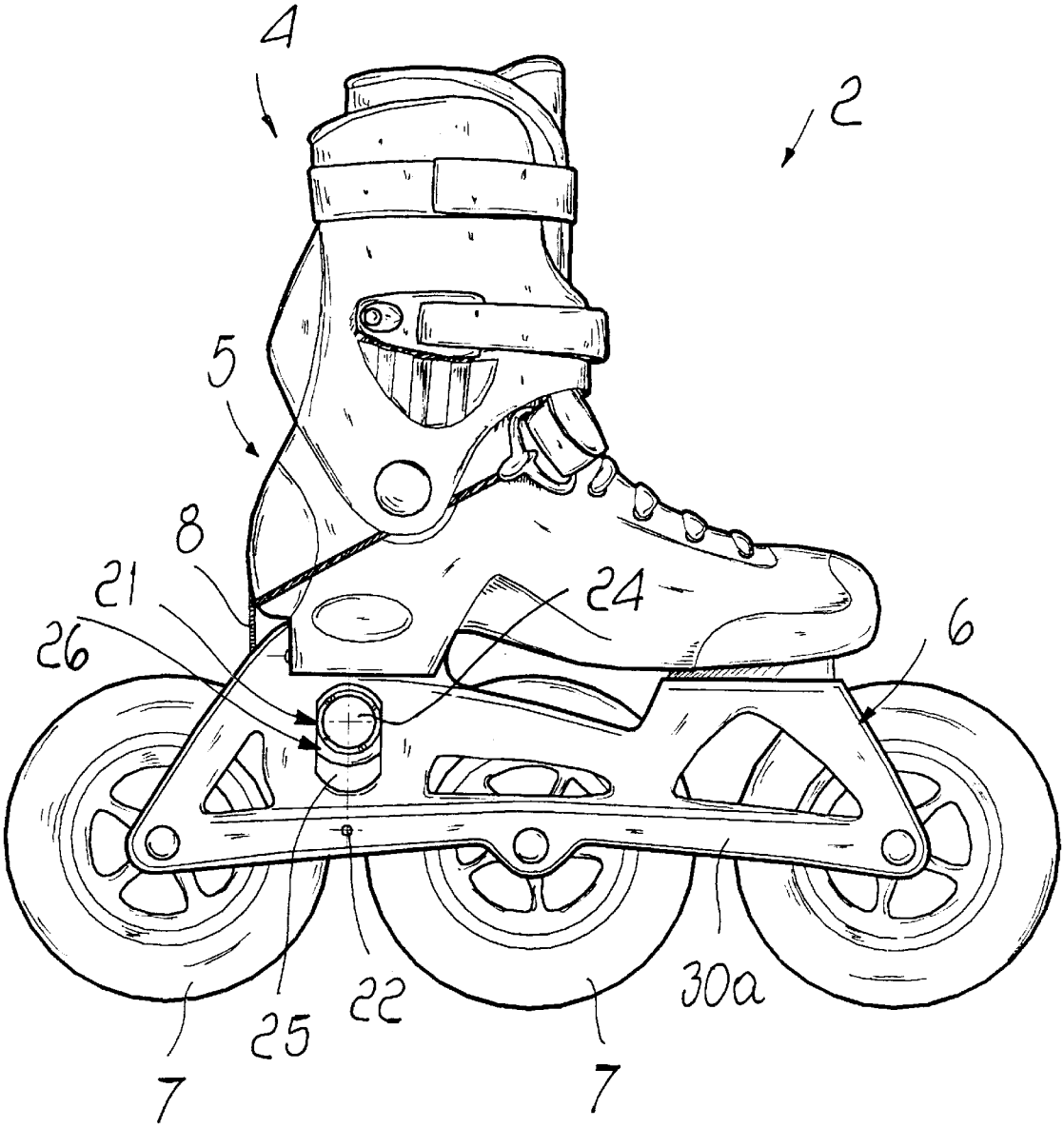
FIG. 1 is a side view of the braking device associated with the skate.
Figure 2:
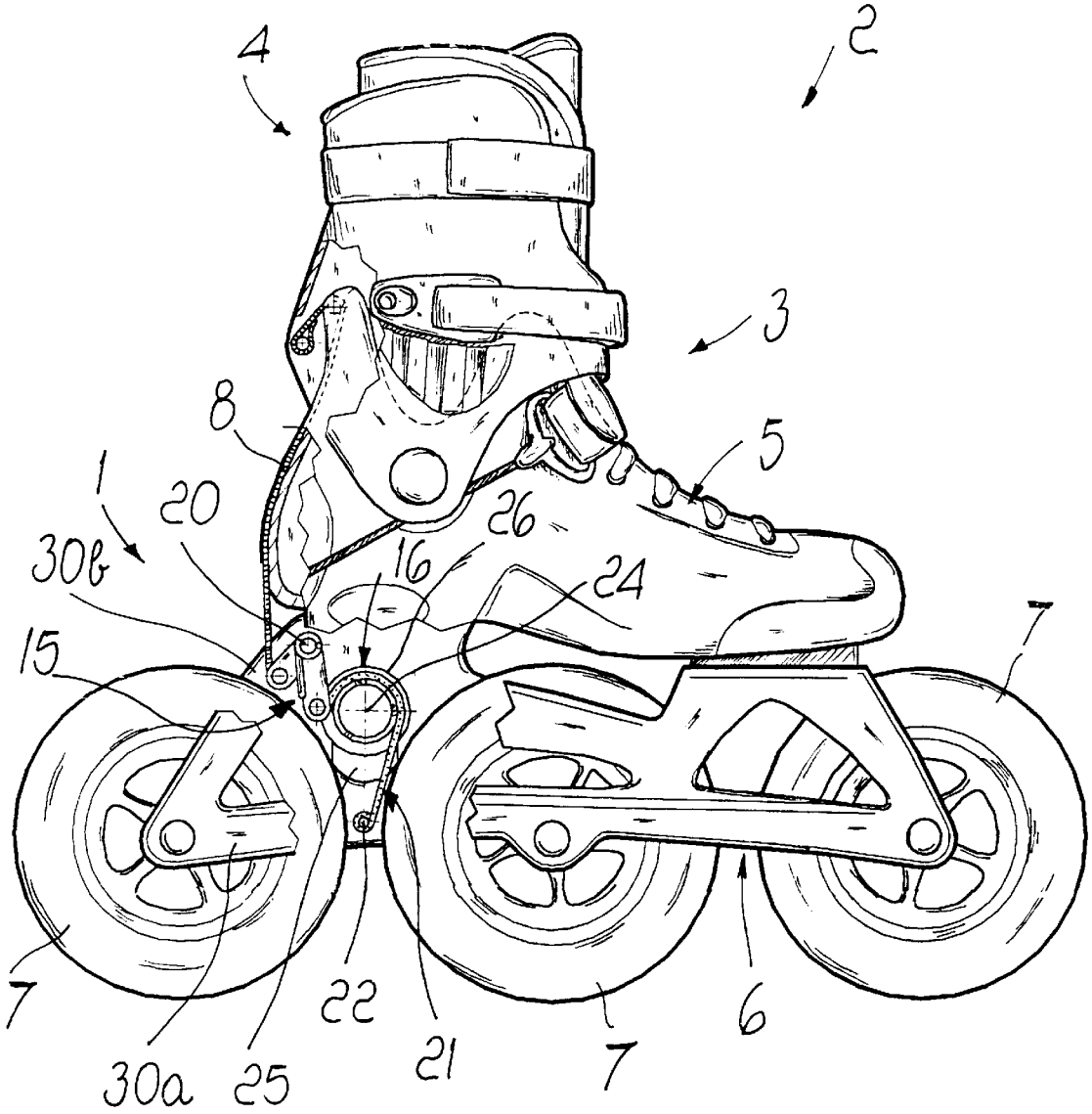
FIG. 2 is a partially sectional side view of the braking device associated with the skate.
Figure 3:
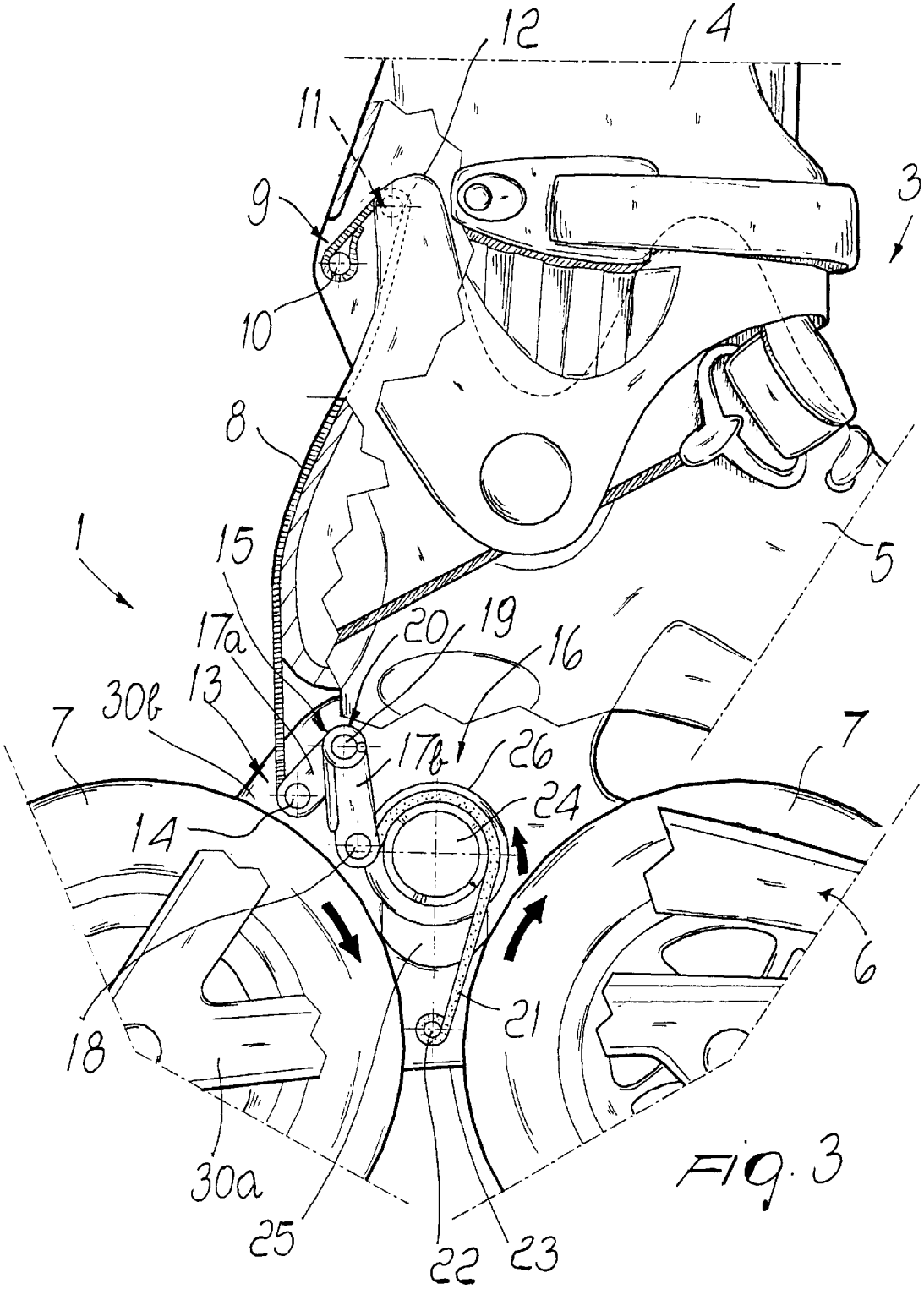
FIG. 3 is a view of a detail of the braking device.

With reference to FIGS. 1–3, the numeral 1 designates the braking device, which is particularly usable for a skate, designated by the reference numeral 2.

The skate comprises a shoe 3 composed of a quarter 4 which wraps around the rear lateral region of the leg of the user and is articulated to a shell 5 below which a frame 6 is associated. The frame has a cross-section in, the shape of an inverted U and accordingly has wings 30*a* and 30*b* for supporting two or more wheels, designated by the reference numeral 7 and optionally arranged mutually in-line.

Provisions are also made for applying conventional fastening levers for the quarter 4 and the shell 5.

The braking device comprises at least one traction element, generally designated by the reference numeral 8, which is preferably constituted by a belt or cable.

The traction element has a first end 9 which is pivoted transversely at an actuation element which is constituted by a first pivot 10 which is rigidly coupled to the rear and internally with respect to the quarter 4.

The traction element 8 is then guided on a means which is rigidly coupled to said shell, such as a second pivot 11 which is associated proximate to the upper perimetric edge 12 of said shell in a region which is slightly raised with respect to the first pivot 10.

The traction element 8 is then made to slide externally, or at least partially internally, with respect to said shell 5 and has a second end 13 which is associated at a third pivot 14 which is part of a lever system 15 suitable to actuate the movement of a braking element 16.

The lever system 15 is essentially constituted by a V-shaped lever, the wings 17*a* and 17*b* of which, preferably having different lengths, have at their free ends the pivot 14 for connection to the traction element 8 and a fourth pivot 18 for connection to the braking element 16.

The region connecting the wings 17*a* and 17*b* has a fifth pivot 19 for free pivoting between the wings 30*a* and 30*b* of the frame 6 in contrast with a flexible element 20 constituted by a spring.

The braking element 16 is instead constituted by a semirigid band 21, preferably made of metal, which is rigidly coupled, at one end, at the fifth pivot 18 and is rigidly coupled, at the other end, at a sixth pivot 22 which is interposed between the wings 30*a* and 30*b* of the frame 6 in a region which is adjacent to the perimetric edge 23 of said wings 30*a* and 30*b*.

The semirigid band 21 interacts with a cylinder 24 which is freely and slidingly associated at a suitable pair of slots 25 formed in the wings 30*a* and 30*b* of the frame 6 along an axis which is approximately perpendicular to the axis along which the wheels rest on the ground, in an intermediate region between two mutually adjacent wheels and slightly above a plane which passes through the pivoting axes of said wheels.

The cylinder 24 is radially provided with a pad 26 which is suitable to interact with the underlying rolling surfaces of the adjacent wheels 7.

The operation of the invention is as follows: in the normal skating condition, the flexible element 20 forces the lever system 15 to assume a position which forces the cylinder 24 at the upper stroke limit of the pair of slots 25; this prevents the pad 26 from interacting with the rolling surfaces of the wheels 7.

A backward rotation of the quarter 4 is followed by a tensioning of the traction element 8, which by means of the lever system 15 forces a downward movement of the cylinder 24 until the pad 26 interacts with the rolling surfaces of the adjacent wheels 7.

When the pad interacts with said rolling surfaces, said surfaces apply to said pad a rotation which is contrasted by a braking action caused by the friction that occurs between the cylinder 24 and the semirigid band 21.

The resulting braking action therefore becomes more effective as the force with which the semirigid band presses at the cylinder 24 increases.

Once the quarter has been returned to an upright position, the flexible element 20 returns the braking element to the condition shown in FIG. 3.

It has thus been found that the invention has achieved the intended aim and objects, a braking device having been obtained which can be activated by the user at a presettable backward rotation angle of the quarter; this can be achieved by setting a chosen length for the traction element and/or by varying the position thereof with respect to the quarter 4.

Furthermore, both the activation and the deactivation of the braking element can be achieved very simply, allowing the user to assume a position which is suitable for controlling the braking action and therefore maintaining optimum balance and arm-leg movement coordination.

The invention is furthermore structurally simple and easy to industrialize, occupies a limited amount of space and has no elements which protrude beyond the external dimensions of the shoe and of the frame, particularly in the lateral and rear regions of the skate.

In this manner, the braking device does not limit any movement of the skater, who can accordingly perform any maneuver without hindrances or obstacles caused by the presence of the braking device.

The invention is of course susceptible of numerous modifications and variations, all of which are within the scope of the same inventive concept.

Figure 4:
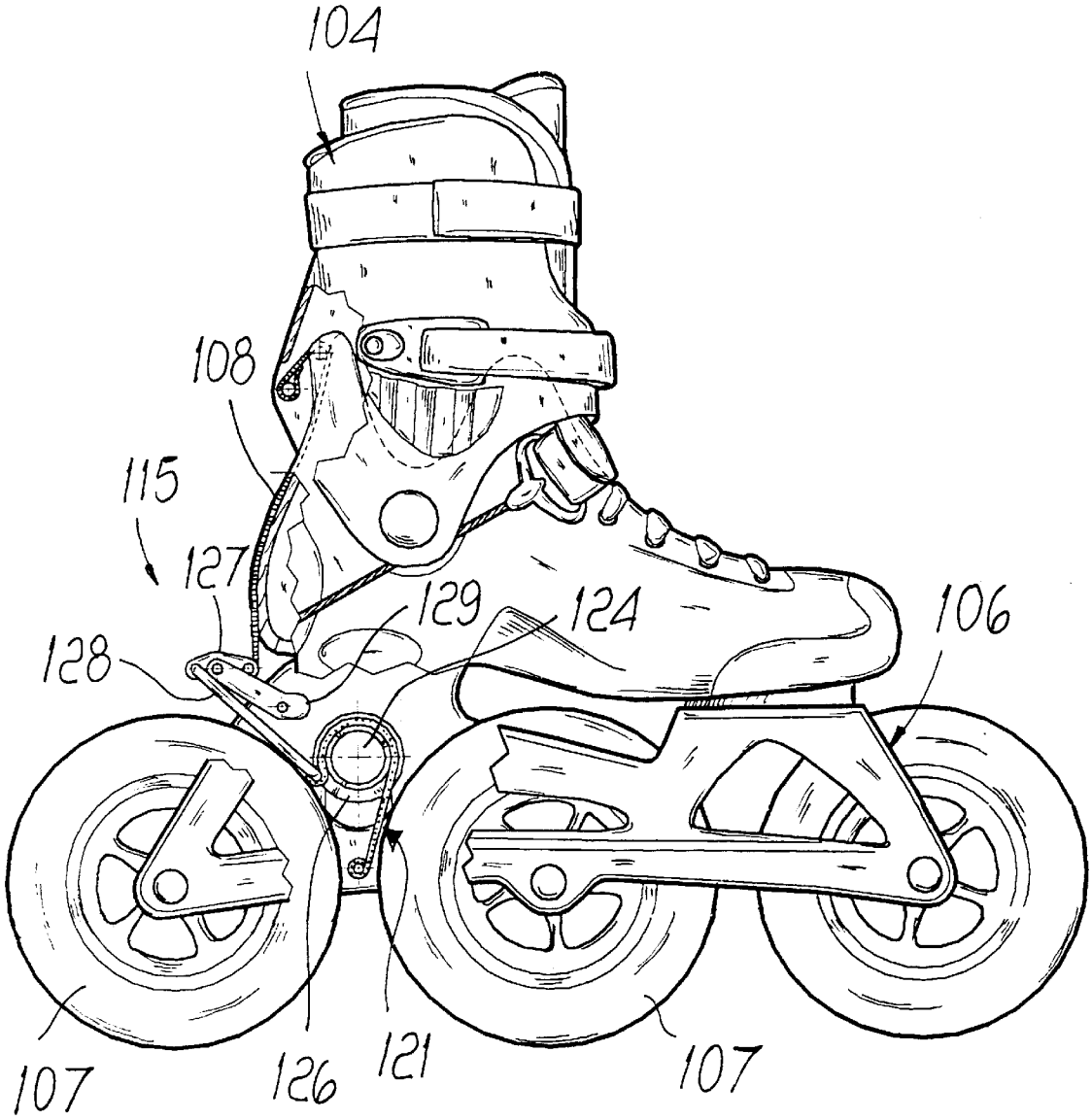
FIG. 4 is a partially sectional side view of another embodiment of the braking device.
Figure 5:
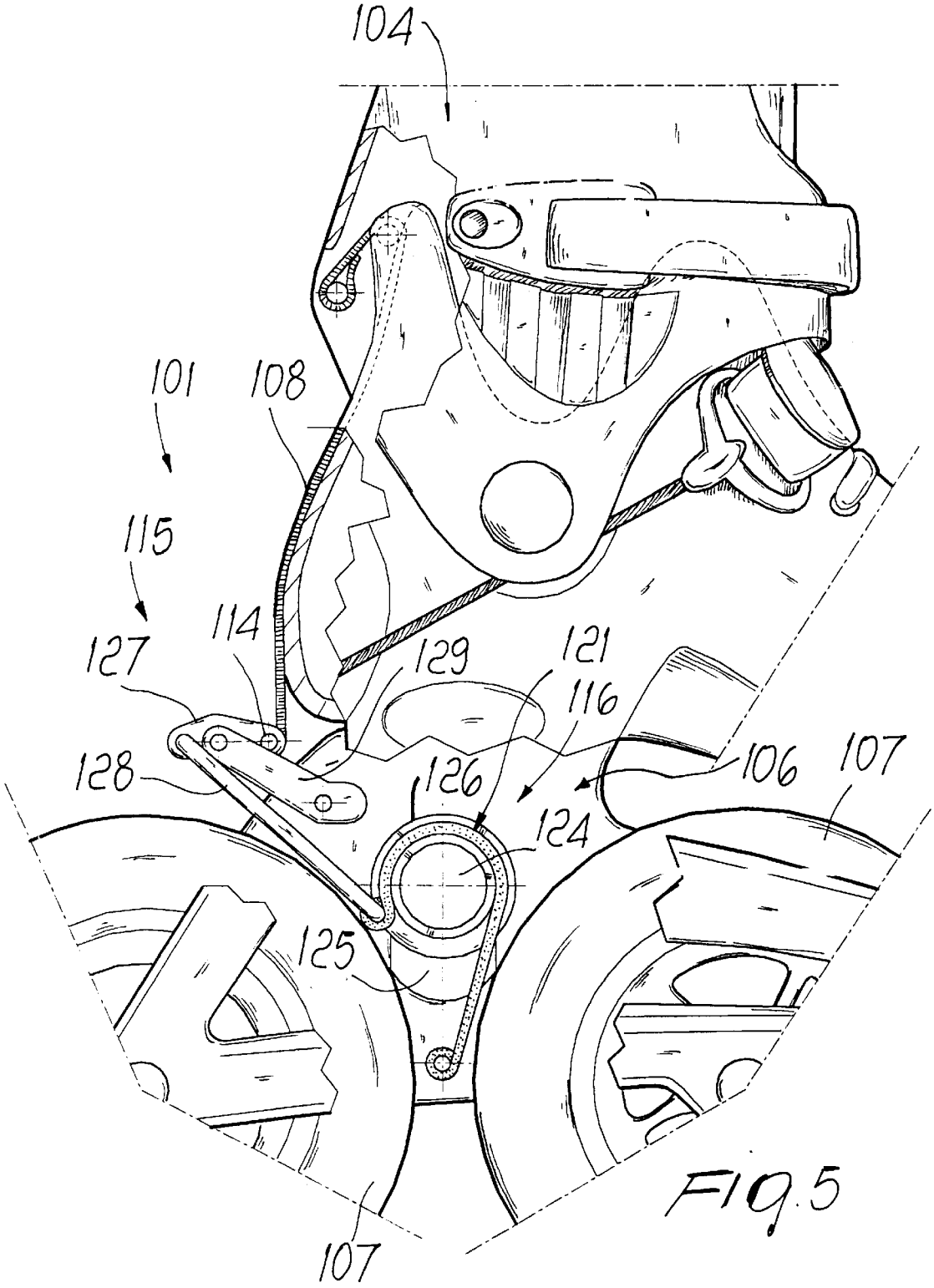
FIG. 5 is a partially sectional side view of the braking device of FIG. 4.

Thus, for example, FIGS. 4 and 5 illustrate a second embodiment of a braking device 101, in which the lever system 115 is constituted by a rocker 127 which is rigidly coupled at its ends to the traction element 108, at the third pivot 114, toward the frame 106, and is rigidly coupled, at the opposite end, at the end of a first rod member 128 which is rigid and U-shaped and is connected to the semirigid band 121 at its other end.

In the intermediate region, the rocker 127 is freely pivoted at the end of a second rod 129 which is rigidly coupled, at its other end, between the wings of the frame 106 in a region above the first rod 128, which in turn lies above the underlying wheel 107.

When using the illustrated embodiment, a backward rotation of the quarter 104 is matched by a takeup of the traction element 108, which turns the rocker 127 counterclockwise; said rocker thus forces the first rod 128 downward, so as to force the cylinder 124 to move downward at the slots 125 until the pad 126 is in contact with the rolling surfaces of the adjacent wheels 107.

The dimensions of the lever system 115 are such as to allow said downward movement without for example the first rod 128 interacting with the underlying wheel 107.

Figure 6:
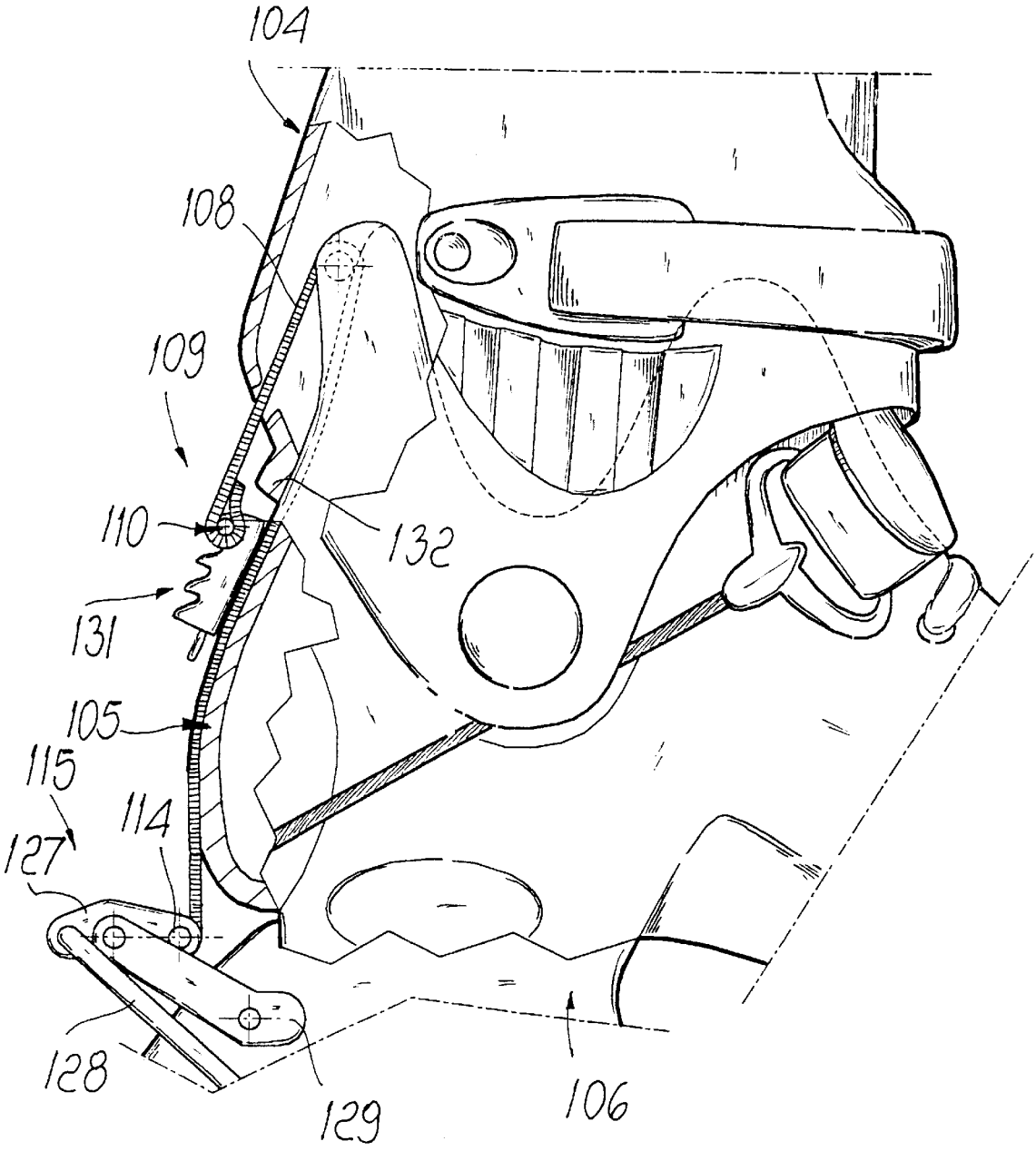
FIG. 6 is a partially sectional side view of another embodiment of the braking device.
Figure 7:
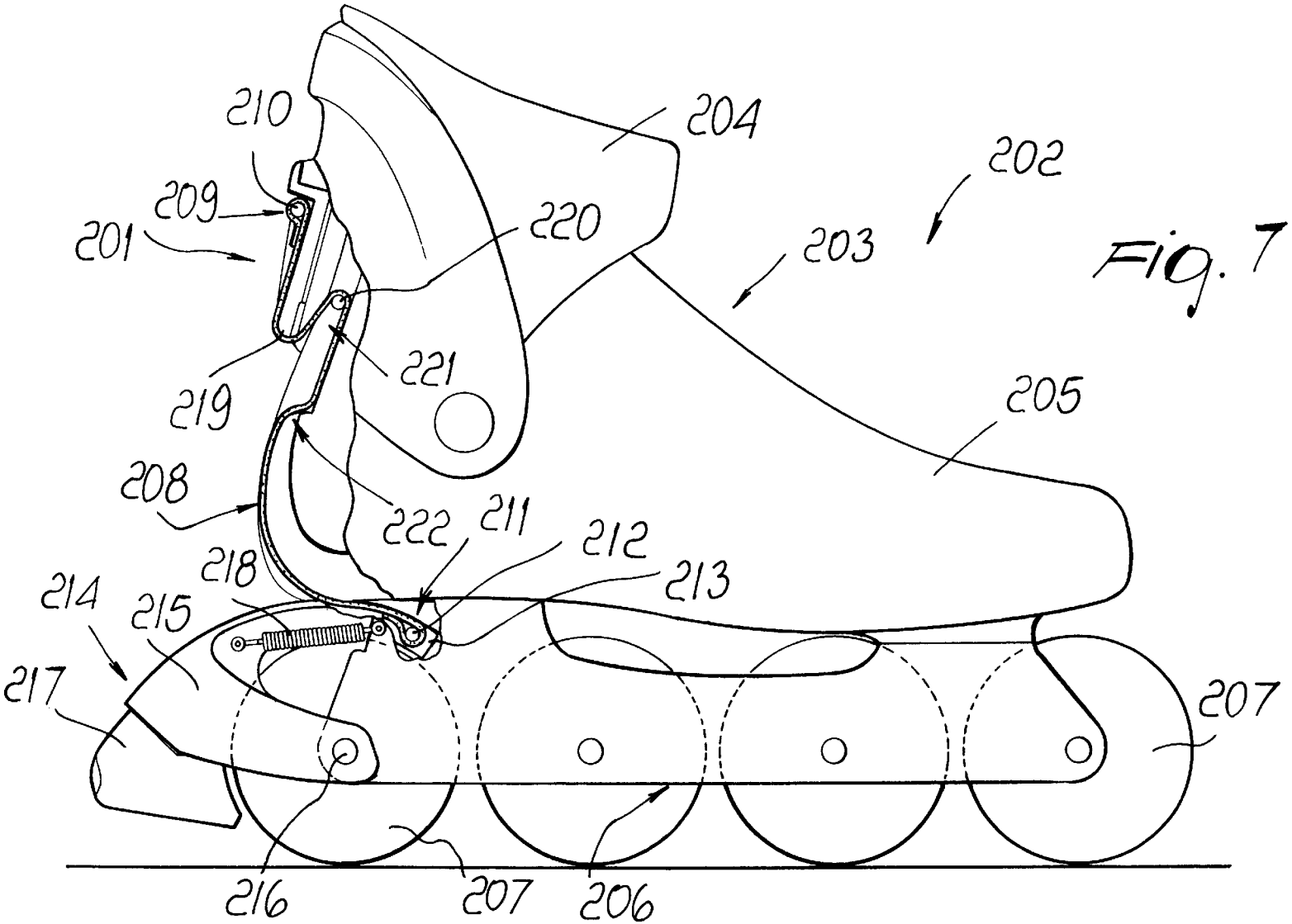
FIG. 7 is a partially sectional side view of the braking device associated with the skate.

In the embodiment shown in FIG. 6, the first end 109 of the traction element 108 is advantageously selectively associable, by virtue of the first pivot 110, with one of a plurality of teeth of an actuator which is constituted by a rack 131 which is slidingly associated at the rear surface of the shell 105.

Activation of the rack 131 occurs by virtue of the interaction of the upper end of said rack with an abutment surface 132 which is provided at the overlying lower perimetric edge of the quarter 104.

Interaction of course occurs beyond a certain angle of backward rotation of the quarter 104.

In this case, the downward movement of the rack applies tension to the traction element 108 and therefore activates the lever system 115 and therefore the braking element 116.

The point where the first end 109 of the traction element 108 connects on the rack 131 can of course be changed according to the specific requirements of the user.

This embodiment, too, achieves the intended aim and objects; it furthermore allows to leave the movement of the quarter completely unhindered in both directions of motion.

This embodiment, in which the traction element 108 is rigidly coupled to the rack 131 instead of to the quarter 104, can of course likewise be applied to the lever system 15 of the embodiment shown in FIGS. 1 to 3.

With reference to FIGS. 7–10, the numeral 201 designates the braking device, which is particularly usable for a skate, designated by the reference numeral 202.

The skate comprises a shoe 203 which is composed of a quarter 204 which wraps around the lateral rear region of the user's leg and is articulated to a shell 205 below which a frame 206 is associated. The frame has a cross-section shaped like an inverted letter U and is adapted to support two or more wheels which are designated by the reference numeral 207 and are optionally arranged mutually in-line.

Provisions are made for applying conventional fastening levers for the quarter 204 and the shell 205.

The braking device comprises at least one traction element, generally designated by the reference numeral 208, which is preferably constituted by a cable or belt.

The traction element has a first end 209 which is associated with the quarter 204 and is then pivoted transversely at a first pivot 210 which is rigidly coupled to the rear and externally with respect to the quarter 204, or is riveted to said quarter or in any case associated by virtue of known connection means.

The traction element 208 has a second end 211 which is associated at a second pivot 212 which is rigidly coupled at the tab 213 that protrudes from a braking element 214 in a region that lies above the last rear wheel 207.

The braking element 214 is constituted by a substantially C-shaped support 215 whose wings are preferably pivoted at a third pivot 216 for pivoting the last wheel 207. A braking pad 217 and said tab 213 are associated with said support 215.

The braking element 214 is allowed to oscillate in contrast with a flexible element, such as a spring 218 which is rigidly coupled, at its ends, at the support 215 and at the frame 206 or at the shell 205.

Starting from its first end 209, the traction element 208 affects the lower perimetric edge 219 of the quarter 204 and is then guided, through an opening 221 formed in said shell, at a fourth pivot 220 which is associated with the shell and arranged transversely thereto.

The traction element 208 then affects the inner lateral surface of the shell and exits from the shell at a second opening 222 formed in a region adjacent to the heel of the user.

The traction element then affects the outer rear surface of the shell up to the second end 211 for pivoting to the second pivot 212; advantageously, the traction element 208 is guided and contained within a recessed seat formed in the shell 205 or in the frame 206, which also allows the sliding of said traction element in the heel region, in which the frame 206 is in contact with the shell.

Use of the invention is as follows: during sports activity and therefore if the quarter is tilted forward, the traction element 208 is not subjected to any tension.

When instead the user forces the quarter to tilt backward beyond a preset angle, the traction element 208 is subjected to a tension which causes the tab 213 of the braking element 214 to perform a counterclockwise movement which as such forces the braking pad 217 into contact with the ground.

Once the need to brake has ceased and therefore the quarter has been returned to an upright position, the presence of the flexible element and therefore of the spring 218 allows the braking pad 217 to lift away from the ground.

It has been found that the invention has achieved the intended aim and objects, a braking device having been obtained which can be activated by the user at a presettable angle of backward rotation of the quarter; this can be achieved by giving the selected length to the traction element and/or by varying the position thereof with respect to the quarter 204.

Furthermore, both activation and deactivation of the braking element can be achieved very simply, allowing the user to assume a position which is suitable to control the braking action and therefore maintaining optimum balance and arm-leg movement coordination.

The invention is structurally simple and easy to industrialize and can also be easily applied to known types of skate.

Figure 9:
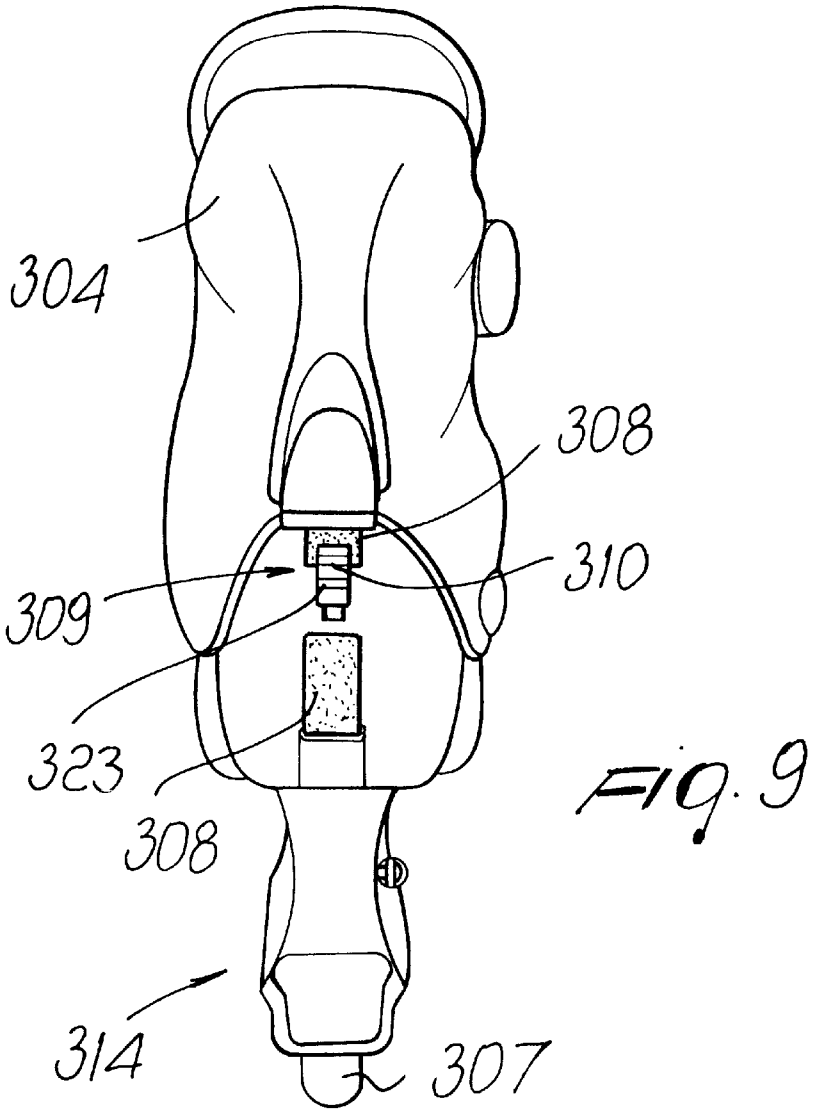
FIG. 9 is a rear view of the skate of FIG. 10.
Figure 8:
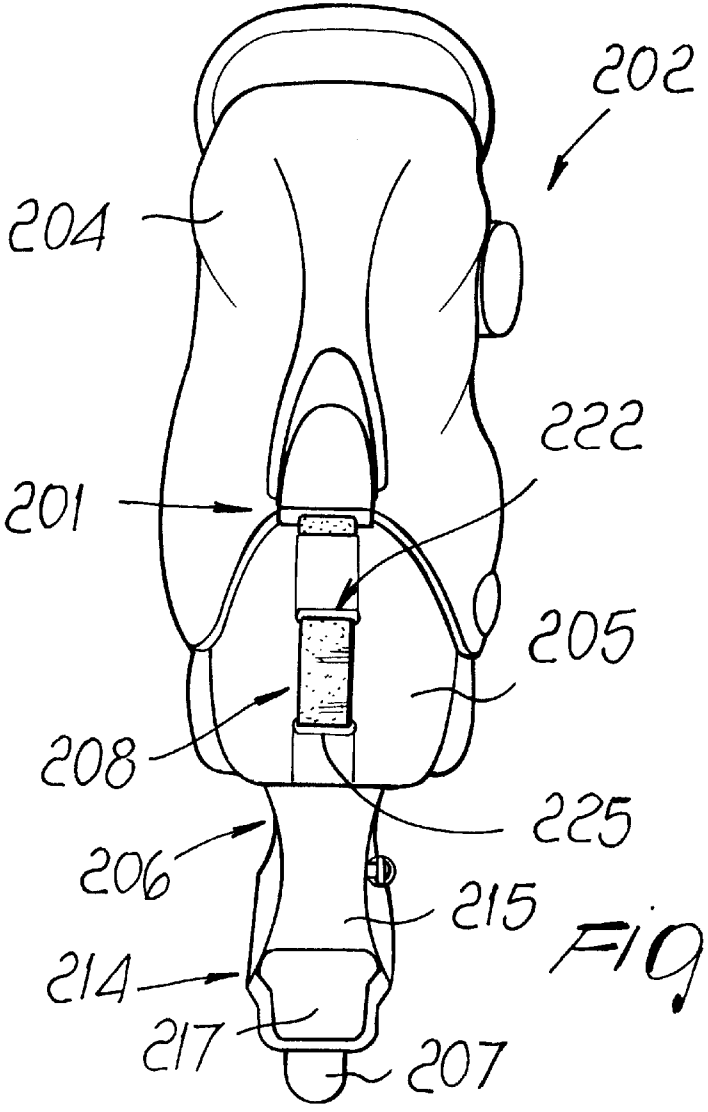
FIG. 8 is a rear view of the skate of FIG. 7.
Figure 10:
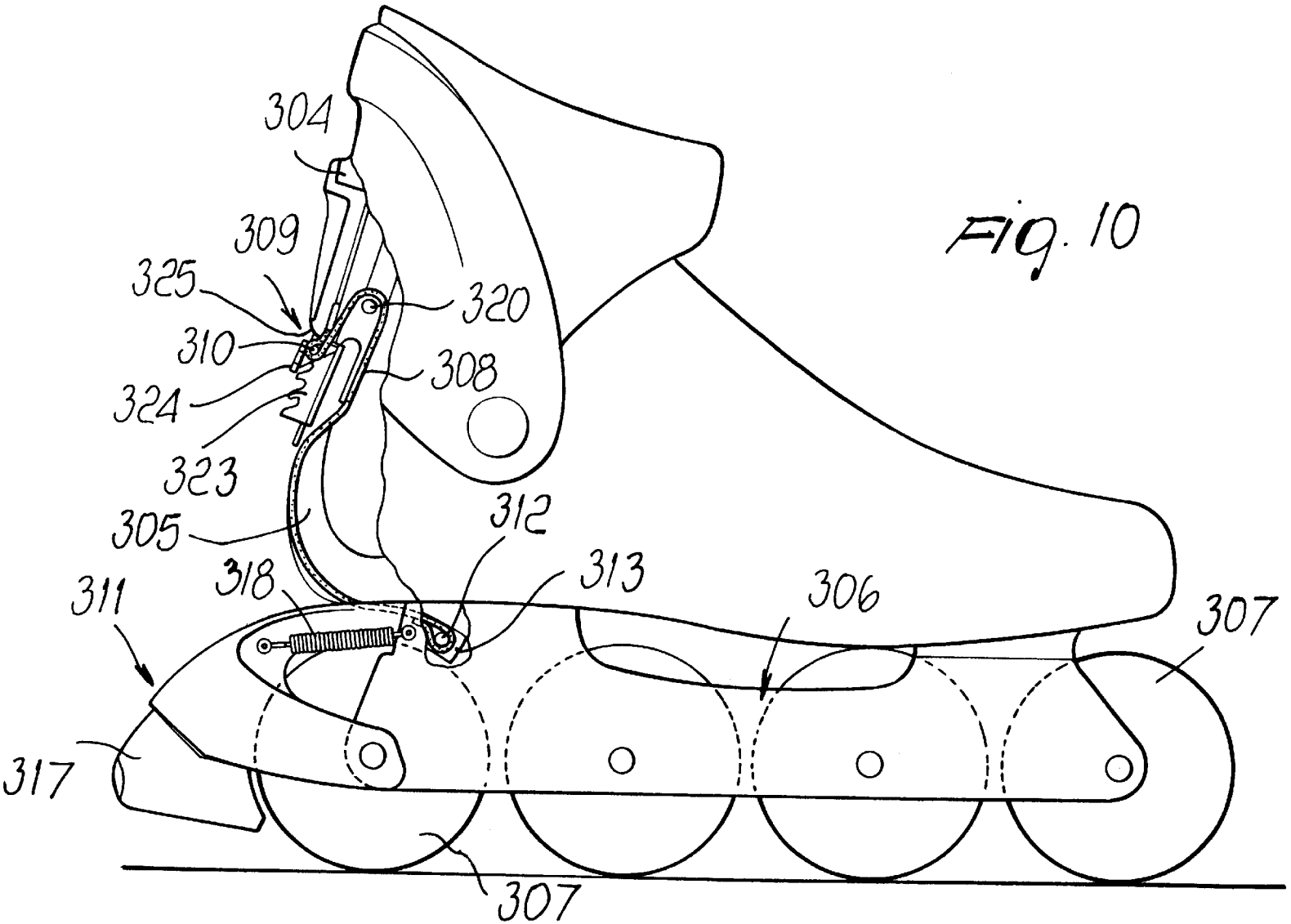
FIG. 10 is a partially sectional side view of another embodiment of the braking device.

FIGS. 9–10 illustrate another embodiment, in which the first end 309 of the traction element 308 is associated at a first pivot 310 which is associated with the upper end of a rack 323 which is slidingly associated at the rear surface of the shell 305.

Complimentarily shaped selective engagement elements 324 of a known type, suitable to preset the position of the rack with respect to the shell, interact with said rack.

The traction element 308 is then guided at a suitable fourth pivot 320 which is arranged in an upward region and transversely inside the shell 305.

The traction element 308 is then made to slide inside said shell 305 to then optionally exit from it and be again associated, at the second end 311, at a second pivot 312 which is rigidly coupled to the tab 313 which protrudes from the braking element 314 above the last wheel 307 pivoted to frame 306.

Operation in this case is as follows: the quarter 304 has, approximately at the lower edge, an abutment surface 325 which interacts with the sliding rack 323 beyond a given backward oscillation angle of said quarter.

Once this angle has been exceeded, by continuing the backward rotation of the quarter the abutment 325 presses against the rack 323, causing it to slide downward along the shell 305 and therefore apply tension to the traction element 308 and produce the consequent counterclockwise movement of the tab 313 so as to force the braking pad 317 into contact with the ground. As in the previous embodiment of FIGS. 7–8, spring 318 connected to braking pad 317 allows the braking pad 317 to lift away from the ground when the quarter returns to an upright position.

This embodiment, too, therefore achieves the intended aim and objects, with the further possibility of disengaging the entire assembly of the braking device from the quarter, with considerable advantages during assembly and allowing greater freedom of forward oscillation of the quarter.

The materials and the dimensions that constitute the individual components of the braking device may of course be the most pertinent according to specific requirements.

The disclosures in Italian Patent Applications No. TV98A000105 and TV98A000133 from which this application claims priority are incorporated herein by reference.

What is claimed is:

1. A braking device in a skate comprising a shoe having a quarter which is articulated to a shell which is associated with a supporting frame rotatably supporting two or more wheels, the skate having a rear region, an inner lateral region, an outer lateral region, and a front region, the braking device comprising a braking element and at least one flexible traction element which slidably extends at said rear region and operatively connects said quarter to said braking element, wherein said at least one traction element has one end connected with an actuation element which is connected to said quarter and said at least one traction element has another end connected to an element which is suitable to actuate the movement, as a result of a rearward tilting of said quarter with respect to said shell and a consequent traction force applied to said at least one traction element by said quarter as it tilts rearwardly, of a braking element into a braking configuration, said braking element being movably connected with said frame in contrast with at least one flexible element which urges said braking element into a non-braking configuration, said traction element having a first end which is associated with said quarter by means of a first pivot, said first pivot being rigidly coupled to said quarter in a rear region and externally, said first end of said traction element being associated at said first pivot which is in turn associated with an upper end of a rack which is slidingly associated at the rear surface of said shell, and said traction element having a second end which is associated at a second pivot which is rigidly coupled to said braking element in a region that lies above a last rear wheel.

2. The braking device in a skate according to claim 1, wherein said traction element is constituted by in element selected from a belt and a cable and has a first end which is pivoted transversely at said actuation element, which comprises a first pivot which is rigidly coupled to the rear and externally with respect to said quarter, and said traction element being then guided on a means which is rigidly coupled to said shell, said means rigidly coupled to said shell being a second pivot which is associated proximate to an upper perimetric edge of said shell in a region which is slightly raised with respect to said first pivot.

3. The braking device in a skate according to claim 2, wherein said traction element slides externally, and at least partially internally, with respect to said shell, and has a second end which is associated at a third pivot which belongs to a lever system which is suitable to actuate the movement of said braking element.

4. The braking device in a skate according to claim 3, wherein said lever system comprises a V-shaped lever with wings which have different lengths, said wings being connected, at respective free ends thereof, to said third pivot and to a fourth pivot for connection to said braking element.

5. The braking device in a skate according to claim 4, wherein a region connecting the wings of said V-shaped lever has a fifth pivot for free pivoting between a pair of parallel wings of said flame in contrast with said flexible element constituted by a spring element.

6. The braking device in a skate according to claim 5, wherein said braking element is connected with said frame in a least one of a sliding manner and a rotating manner in an interspace between two adjacent wheels of the skate.

7. The braking device in a skate according to claim 6, wherein said braking element is constituted by it semirigid band which is rigidly coupled, at one end thereof, at said fourth pivot and is rigidly coupled, at another end thereof, at a sixth pivot which is interposed between said wings of said frame in a region which is adjacent to a perimetric edge of said wings of said frame.

8. The braking device in a skate according to claim 7, wherein said semirigid band interacts with a cylinder which is freely and slidingly associated at slots formed in said wings of said frame along an axis which is approximately perpendicular to an axis along which said wheels rest on the ground, in an intermediate region between two mutually adjacent wheels and slightly above a plane which passes through pivoting axes of said wheels.

9. The braking device in a skate according to claim 8, wherein said cylinder is radially provided with pad which is suitable to interact with underlying rolling surfaces of said two mutually adjacent wheels.

10. The braking device in a skate according to claim 9, wherein said spring element forces said lever system to force said cylinder at an upper stroke limit of said pair of slots whereby preventing said pad from interacting with the underlying rolling surfaces of said two mutually adjacent wheels.

11. The braking device in a skate according to claim 10, wherein said pad performs a rotary motion upon interaction with said underlying rolling surfaces of said two mutually adjacent wheels, said rotary motion being contrasted by a braking action due to friction that occurs between said cylinder and said semirigid band.

12. The bring device in a skate according to claim 3, wherein said lever system comprises a rocker which is rigidly coupled, at a first end thereof, toward said frame, to said traction element at said third pivot and, at a second opposite end thereof, at a first end of a first rigid rod member which is connected, at a second end of said first rigid rod member, to a semirigid band of said braking element, said semirigid band interacting with a cylinder which is freely and slidingly associated at slots formed in said wings of said frame along an axis which is approximately perpendicular to an axis along which said wheels rest on the ground, in an intermediate region between two mutually adjacent wheels and slightly above a plane which passes through pivoting axes of said wheels, said cylinder being radially provided with a pad which is suitable to interact with underlying rolling surfaces of said two mutually adjacent wheels, said pad performing a rotary motion upon interaction with said underlying rolling surface of said two mutually adjacent wheels, said rotary motion being contrasted by a braking action due to friction that occurs between said cylinder and said semirigid band.

13. The braking device in a skate according to claim 12, wherein in an intermediate region said rocker is freely pivoted at a first end of a second rod which is rigidly coupled, at a second end thereof, between said wings of said frame in a region that lies above said first rod, which in turn lies above an underlying wheel.

14. The braking device in a skate according to claim 13, wherein said one end of said traction element is connected with an actuation element which is constituted by a rack which is slidingly associated at a rear surface of said shell.

15. The braking device in a skate according to claim 14, wherein said rack interacts, at an upper end thereof, with an abutment surface which is provided at an overlying lower perimetric edge of said quarter.

16. The braking device in a skate according to claim 15, wherein said traction element is selectively connectable, by virtue of a first pivot, with one of a plurality of teeth of said rack.

17. The braking device in a skate according to claim 1, wherein said traction element is connected to a tab which protrudes from said braking element, said braking element oscillating in contrast with said at least one flexible element constituted by at least one spring element.

18. The making device in a skate according to claim 17, wherein said second pivot is rigidly coupled at said tab which protrudes from said braking element in a region that lies above a last rear wheel.

19. The braking device in a skate according to claim 17, wherein said tab protrudes from a C-shaped support having wings which are pivoted, at ends thereof, at a third pivot for rotation of said last rear wheel, a braking pad being associated with said support on opposite side with respect to said tab.

20. The braking device in a skate according to claim 19, wherein said traction element affects, starting from said first end, a lower perimetric edge of said quarter and is then guided, through an opening formed in said shell, at a fourth pivot which is associated with said shell and is arranged transversely thereto.

21. The braking device in a skate according to claim 20, wherein said traction element affects an internal lateral surface of said shell and exits from said shell at a second opening formed in a region which is adjacent to a heel region of the skate.

22. The braking devices in a skate according to claim 21, wherein said traction element affects an outer rear surface of said shell up to said second end for pivoting to said second pivot.

23. The braking device in a skate according to claim 22, wherein said traction element is guided and contained, between said second opening and said second pivot, within a recessed seat formed in at least one of said shell and said frame.

24. The braking device in a skate according to claim 23, wherein complimentarily shaped selective engagement elements interact with said rack and are suitable to preset a position of said rack with respect to said shell, said traction element being guided at a suitable fourth pivot which is arranged in an upward region and transversely inside said shell.

25. The braking device in a skate according to claim 24, wherein said traction element slides inside said shell and then exits from said shell and is associated, at said second end, at said second pivot which is rigidly coupled to said tab.

26. The braking device in a skate according to claim 25, wherein said quarter has, approximately at a lower edge thereof, an abutment surface which interacts with said rack beyond a given angle of backward oscillation of said quarter.

27. The braking device in a skate according to claim 26, wherein said braking element is allowed to oscillate in contrast with a spring element which is rigidly coupled, at ends thereof, at said support and at one of said frame and said shell.

28. The braking device in a skate according to claim 1, wherein said traction element has a folded portion slidingly extending over a pivot connected with said shell, said folded portion having a concavity slidingly extending over said pivot and directed downwardly in said rear region of said skate.

* * * * *